US012490832B2

(12) United States Patent
Chen et al.

(10) Patent No.: US 12,490,832 B2
(45) Date of Patent: Dec. 9, 2025

(54) FOLDING CHAIR

(71) Applicant: Libin Chen, Changzhou (CN)

(72) Inventors: Libin Chen, Changzhou (CN); Qinglei Kong, Changzhou (CN)

( * ) Notice: Subject to any disclaimer, the term of this patent is extended or adjusted under 35 U.S.C. 154(b) by 183 days.

(21) Appl. No.: 18/408,612

(22) Filed: Jan. 10, 2024

(65) Prior Publication Data

US 2024/0245218 A1 Jul. 25, 2024

(30) Foreign Application Priority Data

Jan. 19, 2023 (CN) ..... 202320150789.3

(51) Int. Cl.
*A47C 4/28* (2006.01)

(52) U.S. Cl.
CPC ..... *A47C 4/286* (2013.01)

(58) Field of Classification Search
CPC ..... A47C 4/28; A47C 4/428; A47C 4/286; A47C 4/30; A47C 4/34; A47C 4/36; A47C 4/38; A47C 4/42; A47C 4/44; A47C 4/46; A47C 4/48; A47C 4/50
See application file for complete search history.

(56) References Cited

U.S. PATENT DOCUMENTS

| | | | | |
|---|---|---|---|---|
| 6,454,348 | B1 * | 9/2002 | Wu | A47C 4/286 297/16.2 |
| 7,942,476 | B2 * | 5/2011 | Chen | A47C 4/286 297/16.2 |
| 10,104,971 | B1 * | 10/2018 | Yang | A47C 5/10 |
| 10,758,054 | B2 * | 9/2020 | Wang | A47C 11/005 |
| 12,053,099 | B2 * | 8/2024 | Choi | A47C 4/286 |
| 2004/0207240 | A1 * | 10/2004 | Tondino | A47C 4/286 297/248 |
| 2008/0100107 | A1 * | 5/2008 | Paslawski | A47C 4/286 297/217.4 |
| 2010/0171342 | A1 * | 7/2010 | Chen | A47C 4/283 297/45 |
| 2019/0038029 | A1 * | 2/2019 | Zhu | A47C 4/283 |
| 2019/0104850 | A1 * | 4/2019 | Frankel | A47C 4/02 |
| 2019/0298066 | A1 * | 10/2019 | Zhu | A47C 4/02 |
| 2020/0154891 | A1 * | 5/2020 | Frankel | A47C 5/10 |
| 2024/0164545 | A1 * | 5/2024 | Hong | A47C 4/286 |

FOREIGN PATENT DOCUMENTS

| | | |
|---|---|---|
| CN | 108260976 A | 7/2018 |
| CN | 114886257 A | 8/2022 |

* cited by examiner

*Primary Examiner* — Chi Q Nguyen
(74) *Attorney, Agent, or Firm* — Bayramoglu Law Offices LLC

(57) ABSTRACT

A folding chair including a folding mechanism. The folding mechanism further includes two support rods respectively hinged to two first connection pieces. A second connection piece is fixed above the first connection pieces on upright rods. When the folding mechanism is unfolded, the second connection pieces are slidably connected to the support rods. When the folding chair is unfolded, a weight on the seat cushion is transferred through the support rods to the first connection pieces and hence, the first connection pieces are pressed and disabled to slide up such that the folding chair is fully unfolded and remains in a stable unfolded state. Furthermore, since the upright rods and the support rods are fixed by the first connection pieces and the second connection pieces when the folding chair is fully unfolded, the folding chair can be carried by simply gripping the upright rods and the support rods.

17 Claims, 12 Drawing Sheets

FOLDING CHAIR

CROSS REFERENCE TO RELATED APPLICATIONS

This application is based upon and claims foreign priority to Chinese Patent Application No. 202320150789.3, filed on Jan. 19, 2023, the entire contents of which are incorporated herein by reference.

TECHNICAL FIELD

The present disclosure relates to the field of chair technologies and in particular to a folding chair.

BACKGROUND

The Chinese patent with the publication number CN108260976A discloses a folding chair, including a locking pin. A through pin hole is opened on an upright rod. When a linkage group and two support mechanism are fully unfolded, the through pin hole is located at an upper part of a slide sleeve and the locking pin is inserted into the through pin hole. Herein, the through pin hole being located at the upper part of the slide sleeve refers to that when the locking pin is inserted into the through pin hole, the slide sleeve cannot slide up the upright rod due to presence of the body of the locking pin, namely, the entire linkage group and support mechanisms cannot be folded up. With the disposal of the locking pin, the folding chair can be locked in a stable state after being unfolded, making it difficult to unfold and improving the stability of the unfolded folding chair. But, the folding chair has the following problem: during use, the locking pin is easily loosened, leading to instability of the folding chair during use, and easily generating potential safety hazards; furthermore, it is possible for the users to forget to use the locking pin for use of the folding chair.

The Chinese patent with the publication number CN114886257A discloses a folding chair, including a support rod and an upright rod. The upright rod is inserted into the support rod and the support rod can move along the upright rod. The upright rod and the support rod are connected by insertion. When the folding chair unfolds and a seat cushion bears a load, the support rod achieves supporting effect on the seat cushion by a suspension strap, and the bottom of the support rod tightly presses a first connection piece (equivalent to the slide sleeve in CN108260976A) to transfer the weight of the seat cushion and a load on the seat cushion by the support rod to the first connection piece so as to press and disable the first connection piece to move upward, thus stabilizing the unfolded folding chair. The above two products are both invented by the applicant. During practical use, it is found that for the folding chair with the publication number CN114886257A, the support rod and the upright rod are slidably sleeved mutually, and thus, when a user grasps the support rod with both hands habitually to carry the unfolded folding chair, the support rod and the upright rod are slid mutually, making it difficult to grasp the entire chair, and thus bringing much inconvenience. Furthermore, due to mutual friction resulting from the mutual slide of the support rod and the upright rod, the support rod and the upright rod may be severely worn out over a long time of use.

SUMMARY

In order to solve the above problem of the folding chairs in the prior arts, the present disclosure provides a folding chair.

For solving the above technical problems, the present disclosure provides the following technical solution: there is provided a folding chair, including a folding mechanism. The folding mechanism includes two oblique support mechanisms, two upright rods and a linkage mechanism. The oblique support mechanisms include two oblique support rods and two bottom frame rods. The linkage mechanism includes two linkage rods crossed and hinged together. Upper ends of the two oblique support rods are hinged to an upper end of one linkage rod by a first connection piece. The first connection pieces are slidably sleeved on the upright rods. First ends of the two bottom frame rods are respectively hinged to two oblique support rods, and second ends of the two bottom frame rods, a lower end of one linkage rod and a lower end of one upright rod are movably connected to realize folding and unfolding of the folding mechanism.

The folding mechanism further includes two support rods respectively hinged to two first connection pieces. A second connection piece is fixed above the first connection piece on the upright rods. When the folding mechanism is unfolded, the second connection pieces are slidably connected to the support rods.

The folding chair further includes a seat cushion. Both sides of the seat cushion are connected with a suspension strap, and the support rods are connected to the suspension straps by a third connection piece and support the suspension straps.

Preferably, the second connection pieces include an elastic C-shaped groove, and groove mouths of the C-shaped grooves have positioning protrusions for blocking the support rods from entering and leaving the corresponding C-shaped grooves. When the folding mechanism is unfolded, the support rods are embedded into the corresponding C-shaped grooves after passing through the positioning protrusions.

Preferably, the support rods include a first embedding part and a second embedding part, and the second connection pieces have a C-shaped groove;

when the oblique support mechanisms are folded up, the first embedding parts are embedded into the corresponding C-shaped grooves;

when the oblique support mechanisms are unfolded, the C-shaped grooves slide along the support rods to the second embedding parts, and the groove mouths of the C-shaped grooves have positioning protrusions capable of blocking the second embedding parts from separating from the corresponding C-shaped grooves.

Preferably, the oblique support mechanisms further include a fourth connection piece. The second ends of two bottom frame rods are hinged to the lower end of one linkage rod by the fourth connection piece. A fifth connection piece is fixed on the linkage rods and the lower ends of the upright rods are hinged to the corresponding fifth connection pieces.

Preferably, the oblique support mechanisms further include a sixth connection piece. The second ends of two bottom frame rods are hinged to the lower end of one linkage rod by the sixth connection piece while the lower end of the corresponding upright rod is fixed to the sixth connection piece.

Preferably, the oblique support mechanisms further include a seventh connection piece. The lower ends of the upright rods are fixed on the corresponding seventh connection pieces, and the lower ends of the linkage rods are hinged to the corresponding seventh connection pieces. The second ends of two bottom frame rods are hinged to the corresponding upright rod.

Preferably, the oblique support mechanisms further include an eighth connection piece. The lower ends of the upright rods are fixed on the corresponding eighth connection pieces, and the second ends of two bottom frame rods are hinged to the corresponding eighth connection piece. The lower ends of two linkage rods are respectively connected to two connection rods. First ends of the two connection rods are hinged by a half folding piece, and the connection rods are hinged to parts, close to the lower ends, of the corresponding upright rods.

Preferably, the connection rods are fixedly provided with a ninth connection piece, and the lower ends of the linkage rods are hinged to the corresponding ninth connection pieces. The oblique support mechanisms further include a tenth connection piece, and a part, close to the lower end, of the oblique support rods is hinged to the first end of the corresponding bottom frame rod by the tenth connection piece.

Preferably, the folding chair further includes an anti-release buckle and a locking pin, where the anti-release buckle and the locking pin are respectively disposed on two first connection pieces.

Preferably, a limiting column capable of radially protruding out of an outer wall of the support rods in a telescoping way is disposed on the support rods. When the folding mechanism is unfolded, the limiting columns block the second connection pieces from sliding down the corresponding support rods.

The present disclosure has the following beneficial effects: when the folding chair is unfolded, a weight on the seat cushion is transferred through the support rods to the first connection pieces and hence, the first connection pieces are pressed and disabled to slide up such that the folding chair is fully unfolded and remains in a stable unfolded state. Secondly, since the upright rods and the support rods are fixed by the first connection pieces and the second connection pieces when the folding chair is fully unfolded, the folding chair can be carried by simply gripping the upright rods and the support rods.

BRIEF DESCRIPTION OF THE DRAWINGS

The present disclosure is further described below in combination with the drawings and specific embodiments.

Figure 1:
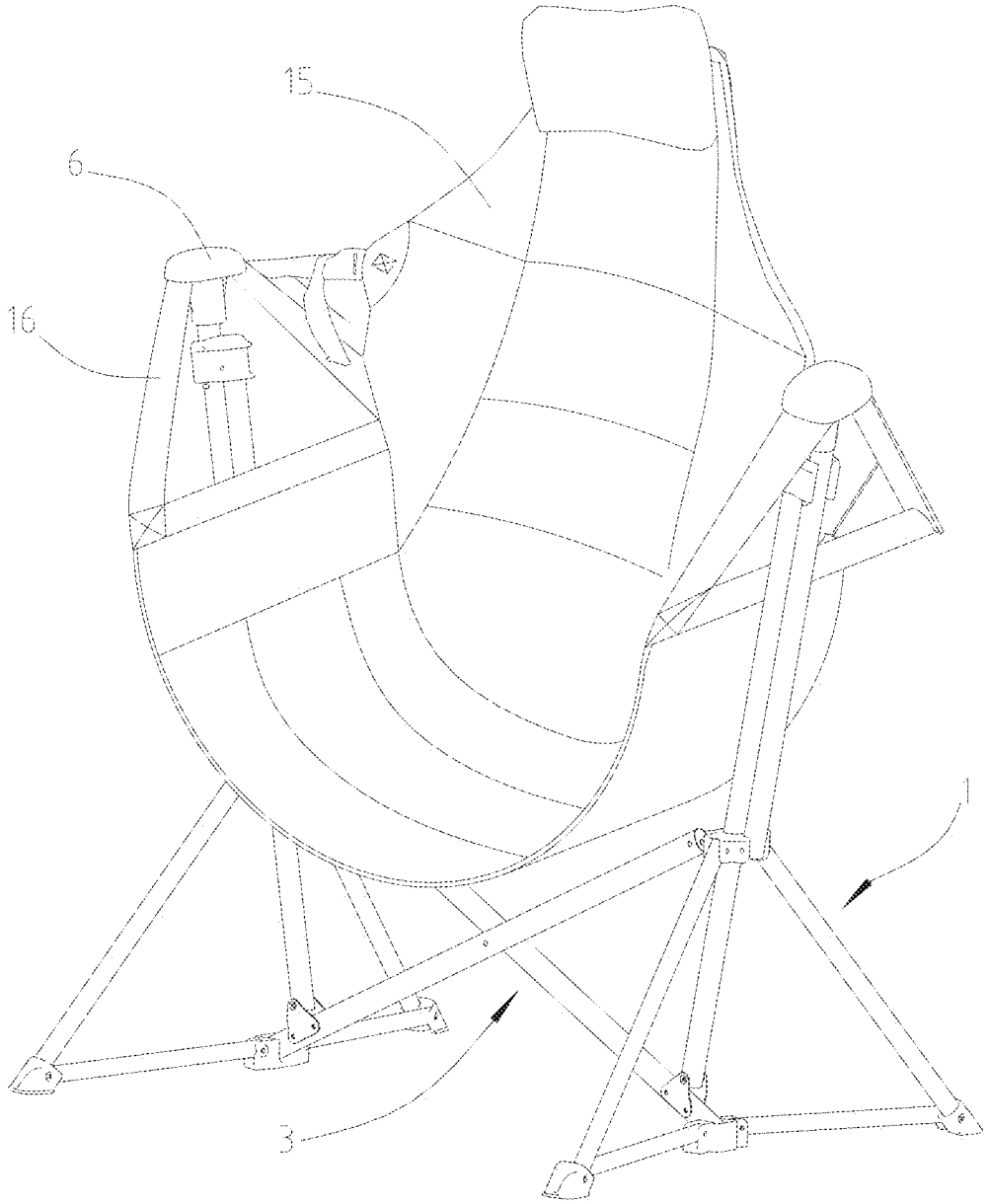
FIG. 1 is a structural schematic diagram of a folding chair according to an embodiment 1 of the present disclosure.
Figure 2:
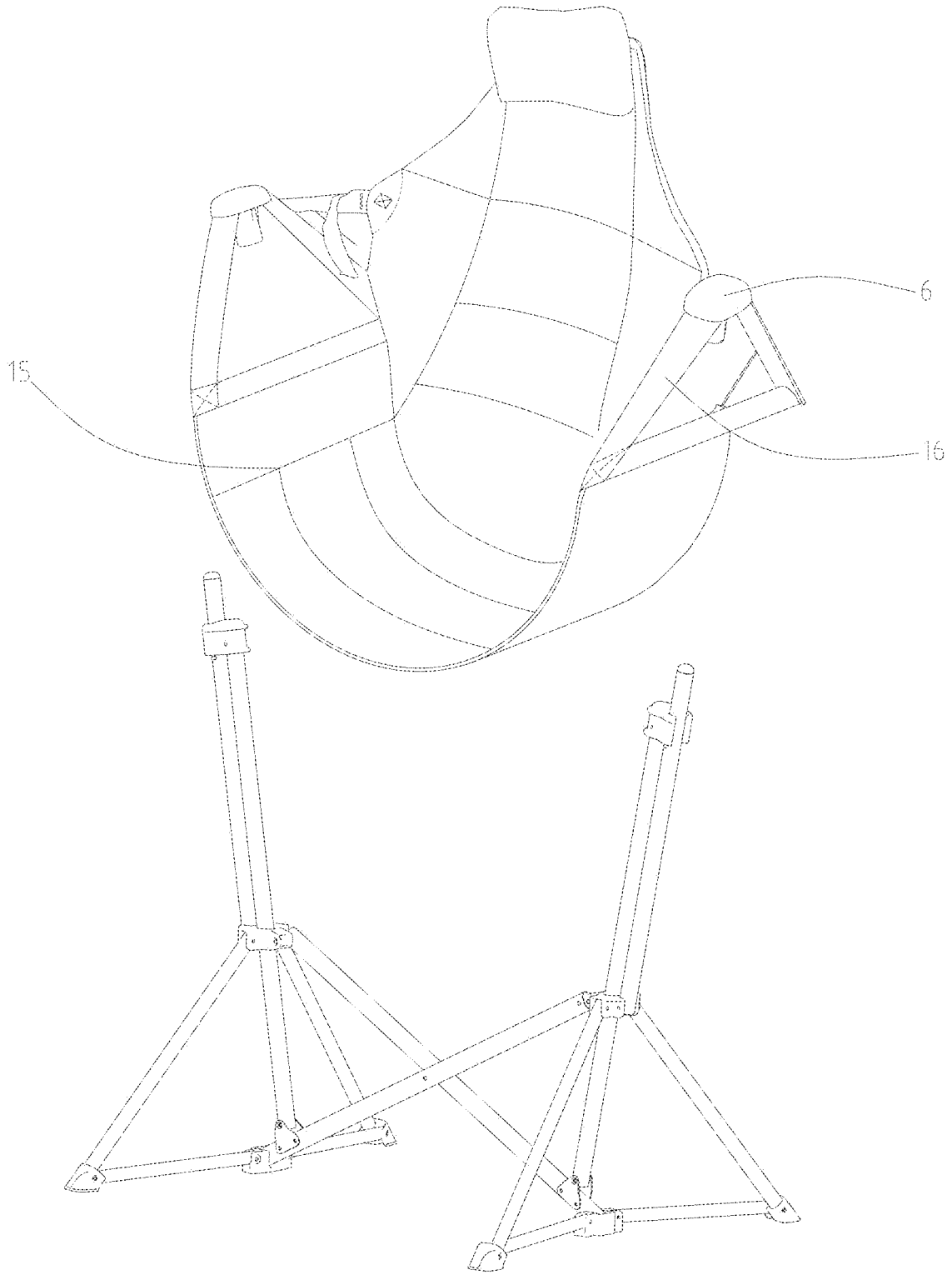
FIG. 2 is a structural schematic diagram illustrating separation of a seat cushion and a folding mechanism of a folding chair according to an embodiment 1 of the present disclosure.
Figure 3:
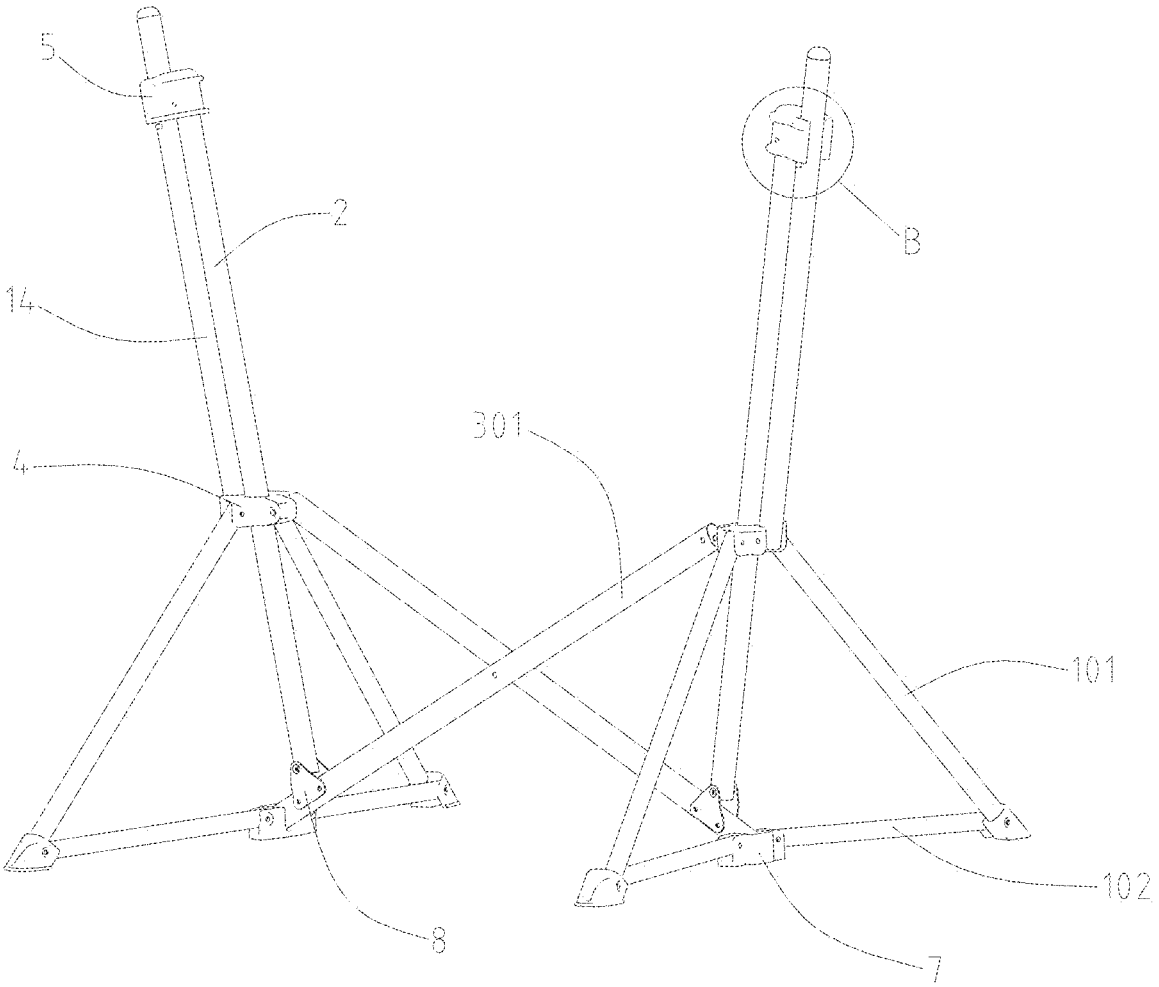
FIG. 3 is a structural schematic diagram illustrating a folding mechanism of a folding chair according to an embodiment 1 of the present disclosure.
Figure 4:
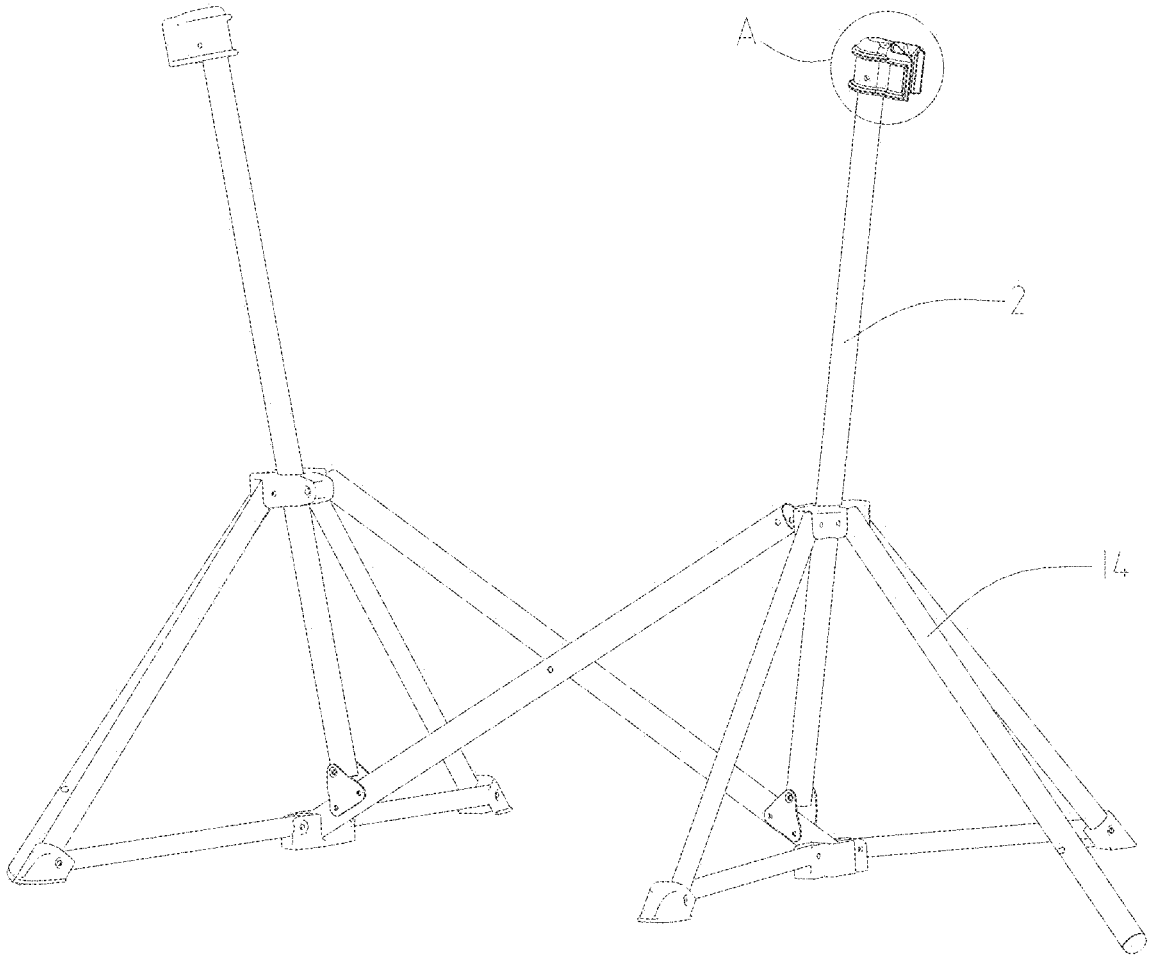
FIG. 4 is a structural schematic diagram of a folding mechanism of a folding chair with support rods put down according to an embodiment 1 of the present disclosure.
Figure 5:
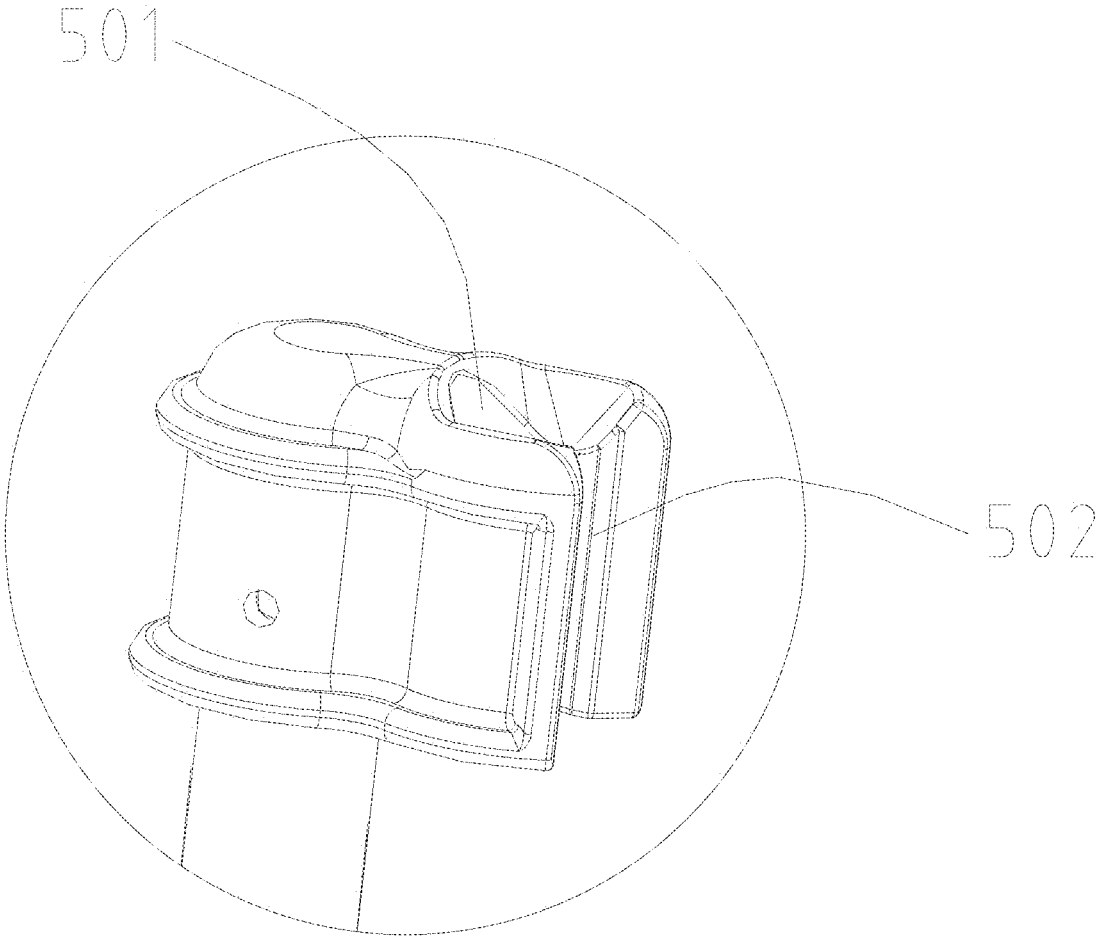
FIG. 5 is an enlarged structural schematic diagram of the position A in FIG. 4.

The numerals of the drawings are described below: 1. oblique support mechanism, 2. upright rod, 3. linkage mechanism, 4. first connection piece, 5. second connection piece, 6. third connection piece, 7. fourth connection piece, 8. fifth connection piece, 9. sixth connection piece, 10. seventh connection piece, 11. eighth connection piece, 12. ninth connection piece, 13. tenth connection piece, 14. support rod, 15. seat cushion, 16. suspension strap, 17. foot disk, 18. half folding piece, 19. anti-release buckle, 20. locking pin, 21. connection rod, 22. limiting column, 101. oblique support rod, 102. bottom frame rod, 301. linkage rod, 501. C-shaped groove, 502. positioning protrusion, 1401. first embedding part, 1402. second embedding part.

DETAILED DESCRIPTION OF THE EMBODIMENTS

The embodiments of the present disclosure will be detailed below with the examples of the embodiments shown in the drawings. Same or similar numerals represent same or similar elements or elements having same or similar functions throughout. The embodiments described below by referring to the drawings are illustrative and used only to interpret the present disclosure and shall not be understood as limiting of the present disclosure.

As shown in FIGS. 1 to 5, the present disclosure provides an embodiment 1 of a folding chair, which includes a folding mechanism including two oblique support mechanisms 1, two upright rods 2 and a linkage mechanism 3. The oblique support mechanisms 1 include two oblique support rods 101 and two bottom frame rods 102. The linkage mechanism 3 includes two linkage rods 301 crossed and hinged at a crossing position. The two linkage rods 301 located between two oblique support mechanisms 1. Upper ends of the two support rods 101 of the oblique support mechanisms 1 are hinged to an upper end of one linkage rod 301 by a first connection piece 4. The first connection pieces 4 are slidably sleeved on the upright rods 2 respectively. First ends of the two bottom frame rods 102 are respectively hinged to lower ends of the two oblique support rods 101 by a support foot. The oblique support mechanisms 1 further include a fourth connection piece 7. Second ends of two bottom frame rods 102 are hinged to a lower end of one linkage rod 301 by the fourth connection piece 7. A fifth connection piece 8 is further fixed on the linkage rods 301 and lower ends of the upright rods 2 are hinged to the corresponding fifth connection pieces 8.

The folding chair further includes two support rods 14, and one end of one of the two support rods 14 is connected to one of two first connection pieces 4. A second connection piece 5 is fixed above the first connection piece 4 on the upright rods 2. The second connection pieces 5 include a C-shaped groove 501 with its groove mouth having a positioning protrusion 502 capable of blocking the support rod 14 from entering and leaving the C-shaped groove 501. When the folding chair is unfolded, the user may hold the support rods 14, rotating the supporting rods 14 around the first connection pieces 4 to the second connection pieces 5. When the support rods 14 are fitted into the C-shaped grooves 501, the support rods 14 will firstly pass through two positioning protrusions 502 of the groove mouths, where a distance between the two positioning protrusions 502 is less than a width of the support rods 14 so as to block the support rods 14 from entering the C-shaped grooves 501. Since the second connection pieces 5 are made of an elastic material such as plastic or metal or the like, the groove mouths of the C-shaped grooves 501 can open slightly under the pressing action of the support rods 14 and thus the support rods 14 can enter the C-shaped grooves 501 through the positioning protrusions 502. After the support rods 14 enter the C-shaped grooves 501, the positioning protrusions 502 can restore to block the support rods 14 from leaving the C-shaped grooves 502. The folding chair further includes a seat cushion 15, both sides of which are connected with a suspension strap 16 respectively. A third connection piece 6 having a positioning groove is fixed on the suspension straps 16. The support rods 14 are pressed into the C-shaped grooves 501 and then inserted into the positioning grooves and thus connected to the suspension straps 16 through the third connection pieces 6, achieving supporting for the suspension straps 16 and the seat cushion 15. The support rods 14 are not fixedly clamped in the spaces of the C-shaped grooves 501 but can be movable relative to the C-shaped grooves 501 in the C-shaped grooves 501. When a person sits on the seat cushion 15, a weight on the seat cushion can be transferred to the first connection pieces 4 through the support rods 14 and thus the first connection pieces 4 are pressed and disabled to move upward. In this case, the folding mechanism of the folding chair is in a stable unfolded state.

In addition to the embodiment 1, the present disclosure further provides embodiments of other several structures of the oblique support mechanisms 1, the upright rods 2 and the linkage mechanism 3.

Figure 6:
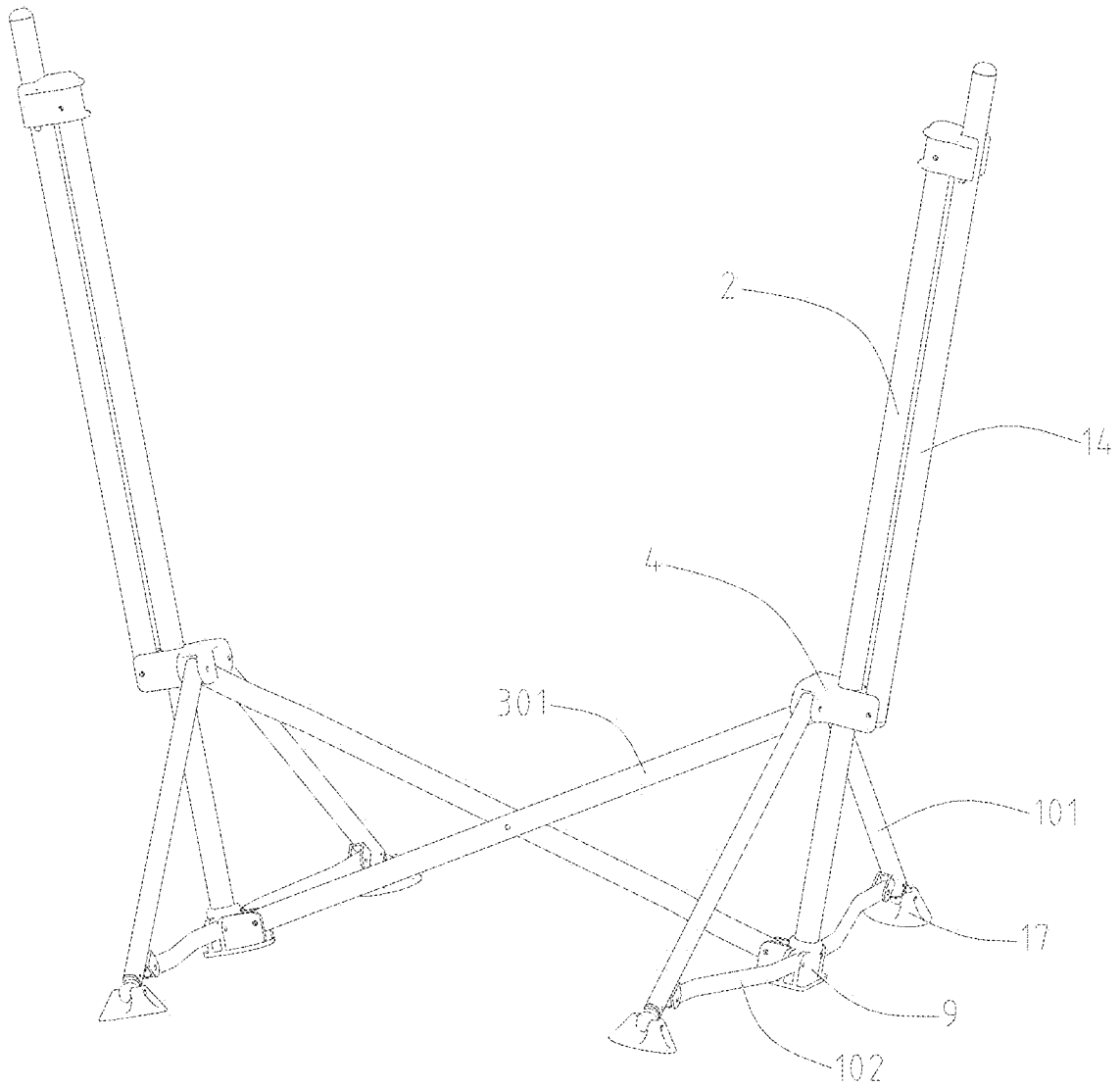
FIG. 6 is a structural schematic diagram illustrating a folding mechanism of a folding chair according to an embodiment 2 of the present disclosure.

As shown in FIG. 6, in an embodiment 2, the oblique support mechanisms 1 further include a sixth connection piece 9. The second ends of the two bottom frame rods 102 are hinged to the lower end of one linkage rod 301 by the sixth connection piece 9 while the lower end of the corresponding upright rod 2 is fixed to the sixth connection piece 9. The lower ends of the oblique support rods 101 are connected to one foot disk 17 by a universal joint to adapt to uneven ground. The first ends of the two bottom frame rods 102 are respectively hinged to parts, close to the lower ends, of the two oblique support rods 101.

Figure 7:
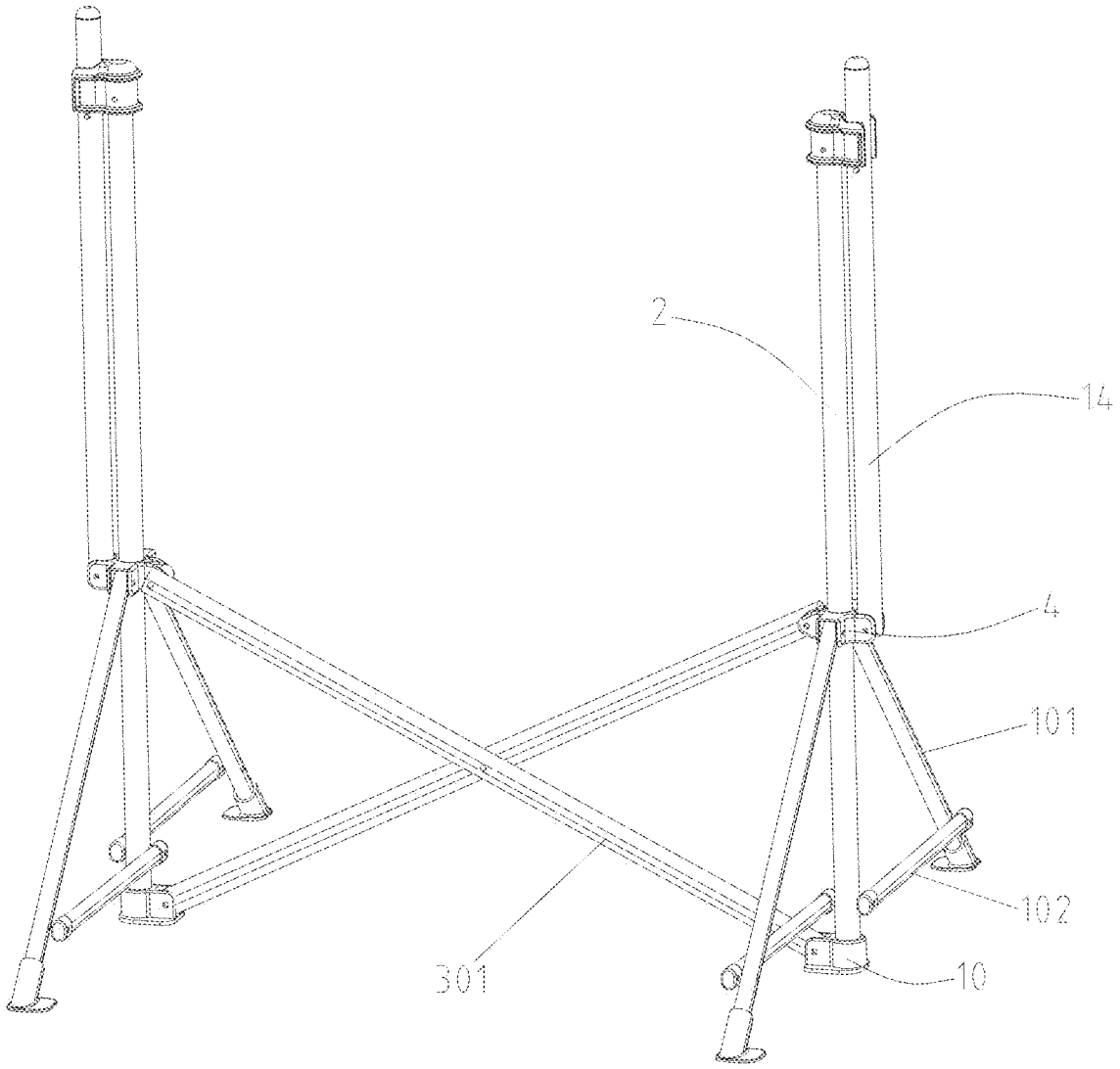
FIG. 7 is a structural schematic diagram illustrating a folding mechanism of a folding chair according to an embodiment 3 of the present disclosure.

As shown in FIG. 7, in an embodiment 3, the oblique support mechanisms further include a seventh connection piece 10. The lower ends of the upright rods 2 are fixed on the corresponding seventh connection pieces 10, the lower ends of the linkage rods 301 are hinged to the corresponding seventh connection pieces 10, and both ends of the bottom frame rods 102 are respectively hinged to the corresponding upright rod 2 and the corresponding oblique support rod 101.

Figure 8:
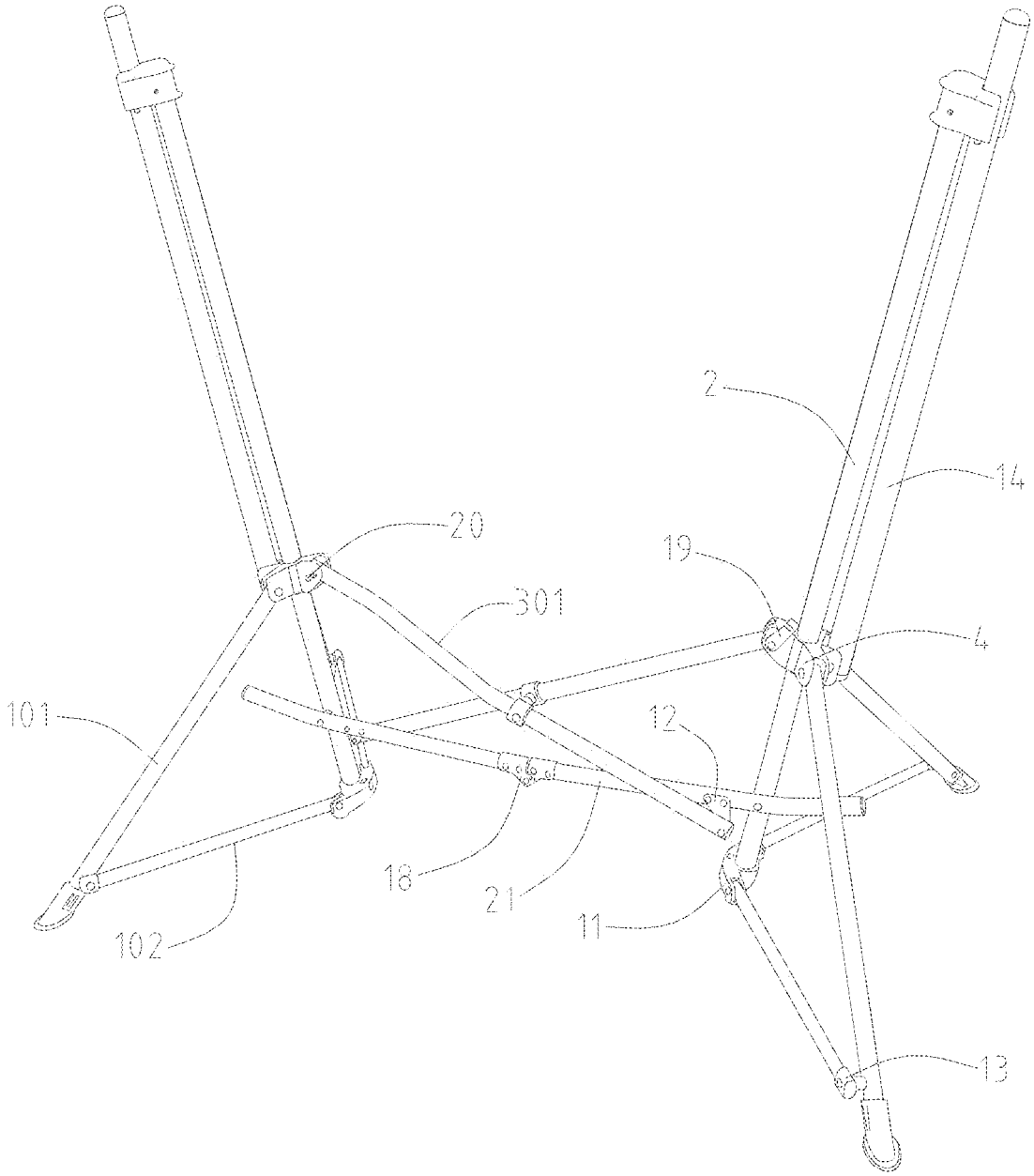
FIG. 8 is a structural schematic diagram illustrating a folding mechanism of a folding chair according to an embodiment 4 of the present disclosure.

As shown in FIG. 8, in an embodiment 4, the oblique support mechanisms 1 further include an eighth connection piece 11 and a tenth connection piece 13. The lower end of the upright rods 2 is fixed on the eighth connection piece 11 and the tenth connection piece 13 is located at a part, close to the lower end, of the oblique support rods 101. The first end of the bottom frame rods 102 is hinged to the corresponding oblique support rod 101 by the tenth connection piece 13, and the second end of the bottom frame rods 102 is hinged to the eighth connection piece 11. A connection rod 21 is fixedly provided with a ninth connection piece 12. The lower ends of the two linkage rods 301 are hinged to two ninth connection pieces 12 respectively. The first ends of two connection rods 21 are hinged together by a half folding piece 18, and a part, close to the lower end, of the upright rods 2 is hinged to the corresponding connection rod 21. When the two connection rods 21 are in one straight line, the half folding piece 18 has a V-shaped gap at the hinging position, and the V-shaped gap can be closed by pressing down the half folding piece 18 by an external force. At this time, the two connection rods 21 are presented as a V shape with an opening facing upward, and the first ends of the two connection rods 21 are abutted against each other by the half folding piece 18. When the seat cushion bears a load, the abutting will be intensified so as to increase the structural strength and stability of the folding chair. In this example, the folding chair further includes an anti-release buckle 19 and a locking pin 20 which are respectively disposed on two first connection pieces 4, where the anti-release buckle 19 is hinged to the corresponding first connection piece 4. When the folding chair is folded up, the distance between the two first connection pieces 4 is minimized. At this time, the anti-release buckle 19 is rotated to catch the locking pin 20 so as to make the folded folding chair difficult to unfold.

Figure 9:
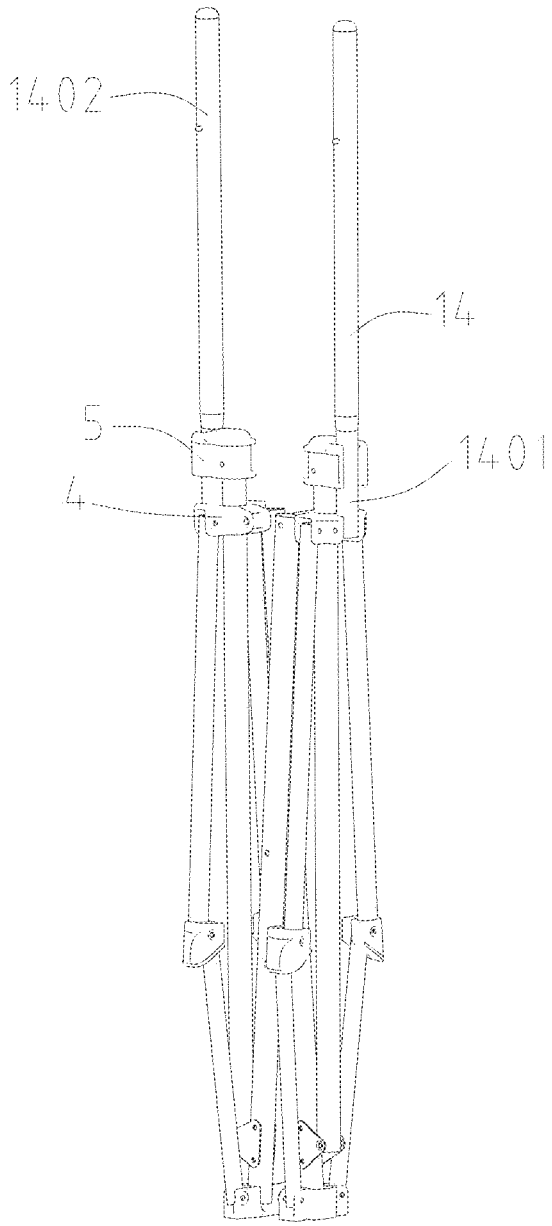
FIG. 9 is a structural schematic diagram illustrating a folded folding mechanism of a folding chair according to an embodiment 5 of the present disclosure.
Figure 10:
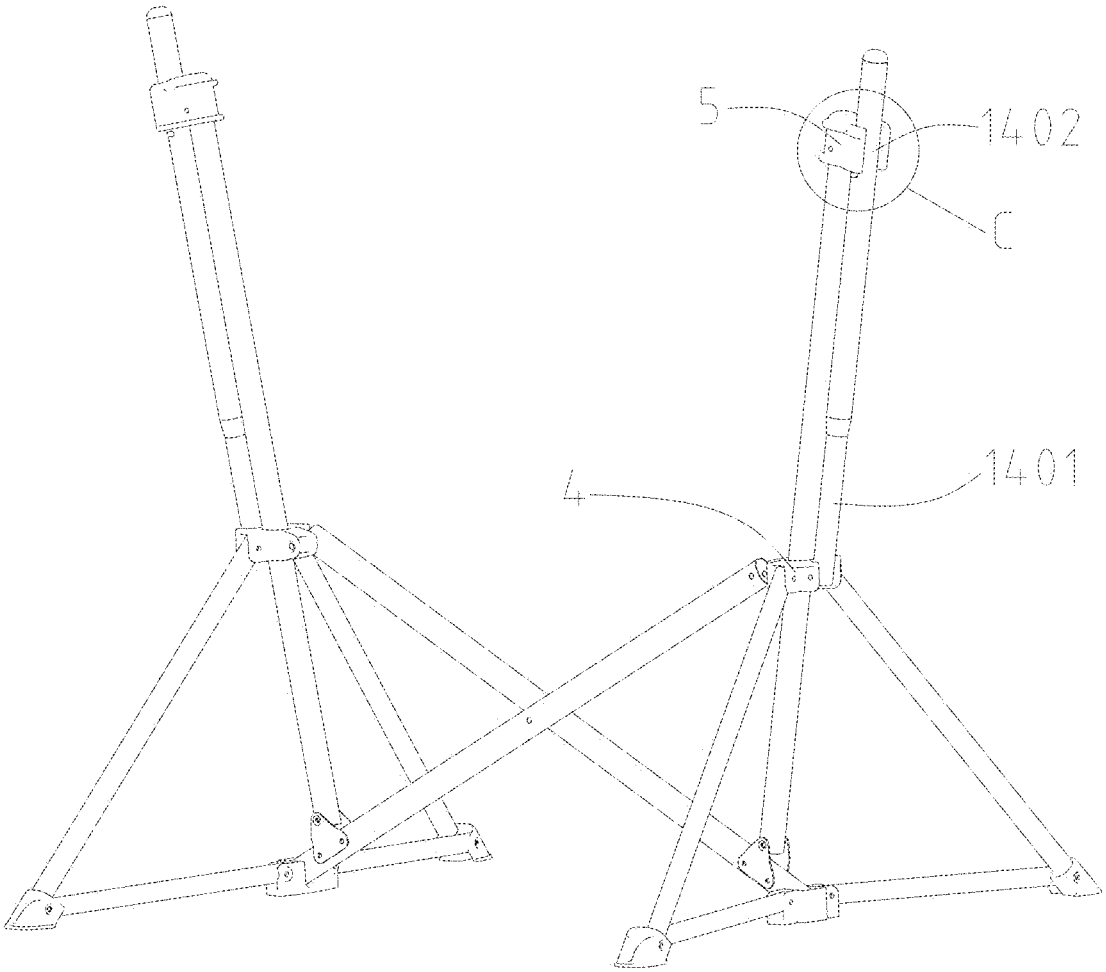
FIG. 10 is a structural schematic diagram illustrating an unfolded folding mechanism of a folding chair according to an embodiment 5 of the present disclosure.

In an embodiment 5, the differences from the embodiment 1 are as follows: the support rods 14 include a first embedding part 1401 close to the corresponding first connection piece 4 and a second embedding part 1402 located above the first embedding part 1401; outer walls of the first embedding part 1401 and the second embedding part 1402 both are cylindrical and a diameter of the outer wall of the first embedding part 1401 is less than a diameter of the outer wall of the second embedding part 1402. As shown in FIG. 9, the oblique support mechanisms are folded up, the second connection pieces 5 are close to the first connection pieces 4, and the support rods 14 are rotated to embed the first embedding parts 1401 into the corresponding C-shaped grooves. Since the first embedding parts 1401 have a smaller outer diameter and the positioning protrusions have a smaller blocking effect on the first embedding parts 1401, the first embedding parts 1401 can be easily embedded into the corresponding C-shaped grooves. As shown in FIG. 10, when the folding chair is unfolded, the oblique support mechanisms are also gradually unfolded. At this time, the second connection pieces 5 slide up the support rods 14 and hence gradually run away from the first connection pieces 4. When the oblique support mechanisms are fully unfolded, the second connection pieces 5 reach the second embedding parts 1402. At this time, the second embedding parts 1402 are located in the corresponding C-shaped grooves. Since the second embedding parts 1402 have a larger outer diameter and the positioning protrusions have a larger blocking effect on the second embedding parts 1402, it is difficult or impossible for the second embedding parts 1402 to separate out of the corresponding C-shaped grooves through the positioning protrusions, thus enhancing the stability of the folding chair in use. The folding structure of the embodiment 1 is employed in the embodiment 5, and the structures of the first embedding parts 1401 and the second embedding parts 1402 in the embodiment 5 may also be applied to the embodiments 2 to 4.

Figure 11:
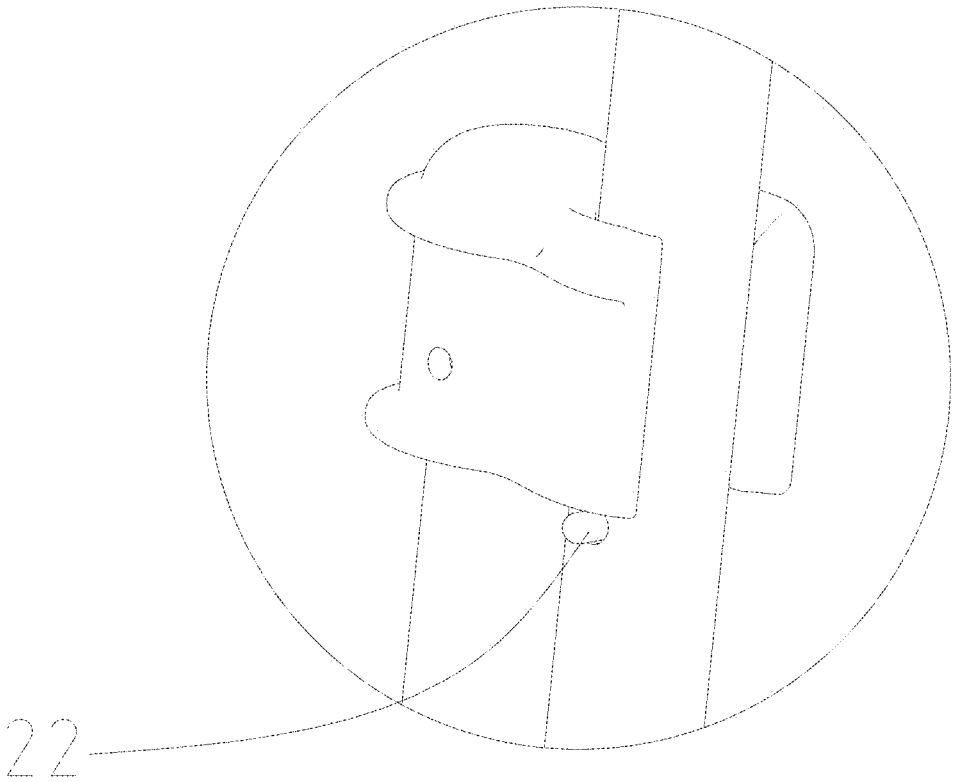
FIG. 11 is an enlarged structural schematic diagram of the position B in FIG. 3.
Figure 12:
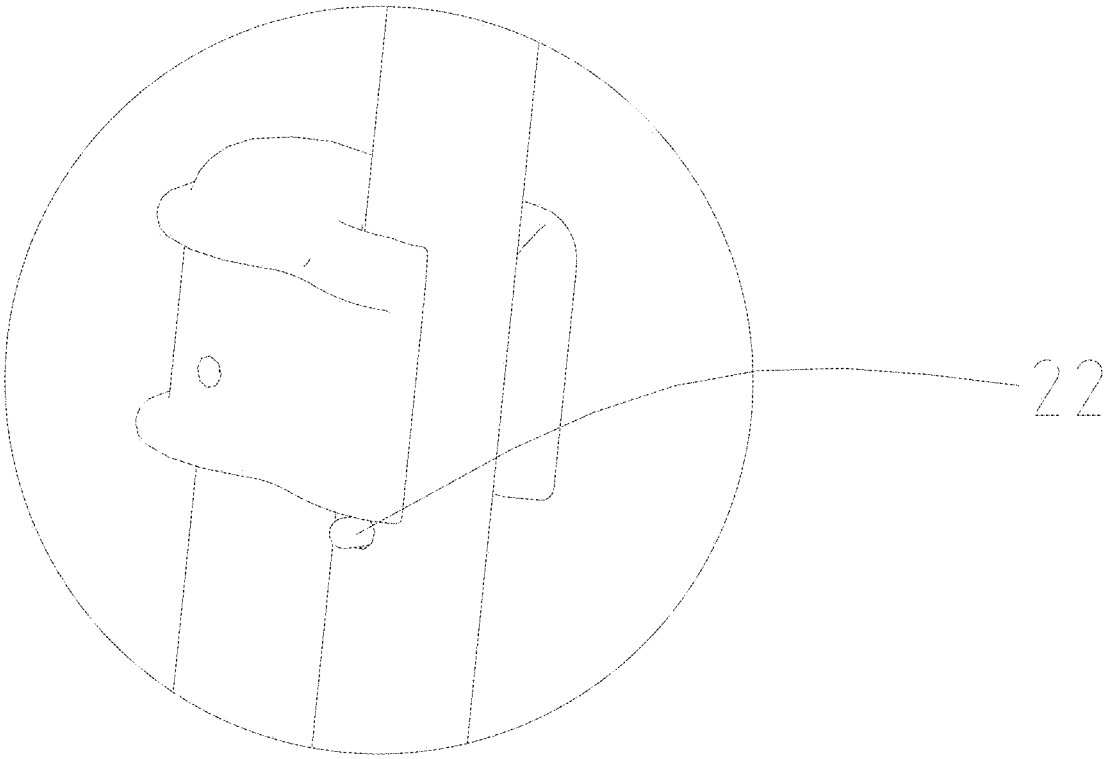
FIG. 12 is an enlarged structural schematic diagram of the position C in FIG. 10.

As shown in FIGS. 11 and 12, in the above implementations, a limiting column (e.g. a spring column) capable of radially protruding out of the outer wall of the support rods in a telescoping way is disposed on the support rods. When the folding mechanism is unfolded, the limiting columns 22 block the second connection pieces from sliding down the support rods, further improving the stability of the unfolded folding mechanism.

What is claimed is:

1. A folding chair, comprising:

a folding mechanism, the folding mechanism comprising two oblique support mechanisms, two upright rods and a linkage mechanism, each of the two oblique support mechanisms comprising two oblique support rods and two bottom frame rods, the linkage mechanism comprising two linkage rods crossed and hinged together, upper ends of the two oblique support rods being hinged to an upper end of one linkage rod by a first connection piece, the two first connection pieces being slidably sleeved on the two upright rods, first ends of the two bottom frame rods being respectively hinged to the two oblique support rods, and second ends of the two bottom frame rods, a lower end of one linkage rod and a lower end of one upright rod being movably connected to realize folding and unfolding of the folding mechanism, wherein;

the folding mechanism further comprises two support rods respectively hinged to the two first connection pieces, a second connection piece is fixed above each of the two first connection pieces on the two upright rods, and in an unfolding state of the folding mechanism, the second connection pieces are slidably connected to the support rods; and the folding chair further comprises a seat cushion, both sides of the seat cushion are connected with a suspension strap, and the support rods are connected to the suspension straps by a third connection piece and support the suspension straps.

2. The folding chair according to claim 1, wherein the second connection pieces comprise an elastic C-shaped groove, groove mouths of the C-shaped grooves have positioning protrusions for blocking the support rods from entering and leaving the corresponding C-shaped grooves, and in the unfolding state of the folding mechanism, the support rods are embedded into the corresponding C-shaped grooves after passing through the positioning protrusions.

3. The folding chair according to claim 2, wherein each of the two oblique support mechanisms further comprises a fourth connection piece, and the second ends of the two bottom frame rods are hinged to the lower end of one linkage rod by the fourth connection piece; a fifth connection piece is fixed on the linkage rods and the lower ends of the upright rods are hinged to the corresponding fifth connection pieces.

4. The folding chair according to claim 2, wherein each of the two oblique support mechanisms further comprises a sixth connection piece, and the second ends of the two bottom frame rods are hinged to the lower end of one linkage rod by the sixth connection piece while the lower end of the corresponding upright rod is fixed to the sixth connection piece.

5. The folding chair according to claim 2, wherein each of the two oblique support mechanisms further comprises a seventh connection piece, the lower ends of the upright rods are fixed on the corresponding seventh connection pieces, the lower ends of the linkage rods are hinged to the corresponding seventh connection pieces, and the second ends of the two bottom frame rods are hinged to the corresponding upright rod.

6. The folding chair according to claim 2, wherein each of the two oblique support mechanisms further comprises an eighth connection piece, the lower ends of the upright rods are fixed on the corresponding eighth connection pieces, the second ends of the two bottom frame rods are hinged to the corresponding eighth connection piece, the lower ends of two linkage rods are respectively connected to two connection rods, first ends of the two connection rods are hinged by a half folding piece, and the connection rods are hinged to parts, close to the lower ends, of the corresponding upright rods.

7. The folding chair according to claim 6, wherein each of the two connection rods are fixedly provided with a ninth connection piece, and the lower ends of the linkage rods are hinged to the corresponding ninth connection pieces; each of the two oblique support mechanisms further comprises a tenth connection piece, and a part, close to the lower end, of the oblique support rods is hinged to the first end of the corresponding bottom frame rod by the tenth connection piece.

8. The folding chair according to claim 7, further comprising an anti-release buckle and a locking pin, wherein the anti-release buckle and the locking pin are respectively disposed on the two first connection pieces.

9. The folding chair according to claim 2, wherein a limiting column capable of radially protruding out of an outer wall of the support rods in a telescoping way is disposed on the support rods; and in the unfolding state of the folding mechanism, the limiting columns block the second connection pieces from sliding down the corresponding support rods.

10. The folding chair according to claim 1, wherein the support rods comprise a first embedding part and a second embedding part, and the second connection pieces have a C-shaped groove;

in a folding-up state of the two oblique support mechanisms, the first embedding parts are embedded into the corresponding C-shaped grooves; and in an unfolding state of the two oblique support mechanisms, the C-shaped grooves slide along the support rods to the second embedding parts; and the groove mouths of the C-shaped grooves have positioning protrusions capable of blocking the second embedding parts from separating from the corresponding C-shaped grooves.

11. The folding chair according to claim 10, wherein each of the two oblique support mechanisms further comprises a fourth connection piece, and the second ends of the two bottom frame rods are hinged to the lower end of one linkage rod by the fourth connection piece; a fifth connection piece is fixed on the linkage rods and the lower ends of the upright rods are hinged to the corresponding fifth connection pieces.

12. The folding chair according to claim 10, wherein each of the two oblique support mechanisms further comprises a sixth connection piece, and the second ends of the two bottom frame rods are hinged to the lower end of one linkage rod by the sixth connection piece while the lower end of the corresponding upright rod is fixed to the sixth connection piece.

13. The folding chair according to claim 10, wherein each of the two oblique support mechanisms further comprises a seventh connection piece, the lower ends of the upright rods are fixed on the corresponding seventh connection pieces, the lower ends of the linkage rods are hinged to the corresponding seventh connection pieces, and the second ends of the two bottom frame rods are hinged to the corresponding upright rod.

14. The folding chair according to claim 10, wherein each of the two oblique support mechanisms further comprises an eighth connection piece, the lower ends of the upright rods are fixed on the corresponding eighth connection pieces, the second ends of the two bottom frame rods are hinged to the corresponding eighth connection piece, the lower ends of two linkage rods are respectively connected to two connection rods, first ends of the two connection rods are hinged by a half folding piece, and the connection rods are hinged to parts, close to the lower ends, of the corresponding upright rods.

15. The folding chair according to claim 14, wherein each of the two connection rods are fixedly provided with a ninth connection piece, and the lower ends of the linkage rods are hinged to the corresponding ninth connection pieces; each of the two oblique support mechanisms further comprises a tenth connection piece, and a part, close to the lower end, of the oblique support rods is hinged to the first end of the corresponding bottom frame rod by the tenth connection piece.

16. The folding chair according to claim 15, further comprising an anti-release buckle and a locking pin, wherein the anti-release buckle and the locking pin are respectively disposed on the two first connection pieces.

17. The folding chair according to claim 10, wherein a limiting column capable of radially protruding out of an outer wall of the support rods in a telescoping way is disposed on the support rods; and in the unfolding state of the folding mechanism, the limiting columns block the second connection pieces from sliding down the corresponding support rods.

* * * * *